US006607031B2

(12) United States Patent
Lynde et al.

(10) Patent No.: US 6,607,031 B2
(45) Date of Patent: Aug. 19, 2003

(54) SCREENED BOOT BASKET/FILTER

(75) Inventors: Gerald D. Lynde, Houston, TX (US); Gregory L. Hern, Huffman, TX (US)

(73) Assignee: Baker Hughes Incorporated, Houston, TX (US)

( * ) Notice: Subject to any disclaimer, the term of this patent is extended or adjusted under 35 U.S.C. 154(b) by 40 days.

(21) Appl. No.: 09/847,916

(22) Filed: May 3, 2001

(65) Prior Publication Data

US 2002/0162655 A1 Nov. 7, 2002

(51) Int. Cl.[7] ..... E21B 31/08; E21B 34/14
(52) U.S. Cl. ..... 166/99; 166/205; 166/334.4
(58) Field of Search ..... 166/373, 381, 166/386, 99, 105.1, 105.3, 164, 205, 265, 332.1, 227, 317, 334.1, 334.4

(56) References Cited

U.S. PATENT DOCUMENTS

| | | | | | |
|---|---|---|---|---|---|
| 2,332,267 | A | | 10/1943 | Sewell | |
| 2,834,300 | A | | 5/1958 | Brock | |
| 2,874,781 | A | * | 2/1959 | McGaffey | 166/167 |
| 2,993,539 | A | | 7/1961 | Baker | |
| 3,120,872 | A | | 2/1964 | Anderson | |
| 4,478,285 | A | * | 10/1984 | Caldwell | 166/105.1 |
| 4,515,212 | A | | 5/1985 | Krugh | |
| 5,176,208 | A | * | 1/1993 | Lalande et al. | 166/162 |
| 5,330,003 | A | | 7/1994 | Bullick | |
| 5,564,500 | A | * | 10/1996 | Rogers et al. | 166/222 |
| 5,628,366 | A | * | 5/1997 | Telfer | 166/380 |
| 5,865,251 | A | * | 2/1999 | Rebardi et al. | 166/278 |
| 5,944,100 | A | * | 8/1999 | Hipp | 166/66.5 |
| 6,170,577 | B1 | * | 1/2001 | Noles et al. | 166/222 |
| 6,186,227 | B1 | * | 2/2001 | Vaynshteyn et al. | 166/120 |
| 6,296,055 | B1 | * | 10/2001 | Taylor | 166/205 |

FOREIGN PATENT DOCUMENTS

| | | |
|---|---|---|
| GB | 2335218 | 9/1999 |
| GB | 2335687 | 9/1999 |

OTHER PUBLICATIONS

SPS Information Sheet for "Well Patroller", Mar. 1999, 1 page.
Tri–State Oil Tool Industries, Inc., Catalog Sheet for "Tri–State Boot Basket", 1957, 1 page.
Baker Oil Tools Product Report for "VACS" Product Family No. H13125, Nov. 1999, 1 page.
Baker Oil Tools Product Report for "VACS" Product Family No. H13016, 1957, 1 page.

* cited by examiner

*Primary Examiner*—David Bagnell
*Assistant Examiner*—Jennifer H Gay
(74) *Attorney, Agent, or Firm*—Steve Rosenblatt

(57) ABSTRACT

A downhole debris filtering apparatus has the flow diverter retracted as the tool is run in. Settling velocity is the rate at which debris will fall through the fluid. Settling velocity is dependent on the density of the fluid and the debris density. If the fluid velocity exceeds the settling velocity, the debris will rise. The restricted annular area outside the screens raises the fluid velocity. Above the cup sleeve, the annular area increases significantly and the fluid velocity is reduce to below the settling velocity to allow debris to settle to the bottom of the tool. On run in, the fluid merely bypasses on the outside of the filter. Large debris will settle into the tool as described. When pulled out of the hole the swab cup/flow diverter is actuated into casing or liner wall contact and a large passage is opened to allow flow though the filter. Small debris that has risen above the tool will be captured as the fluid is filtered through the screen. Another embodiment with a non-retractable cup uses a sliding sleeve valve with a large open area.

32 Claims, 12 Drawing Sheets

SCREENED BOOT BASKET/FILTER

FIELD OF THE INVENTION

The field of this invention is downhole cleanup of casing and liners and more particularly after cementing and before completion.

BACKGROUND OF THE INVENTION

The cementing process is known to leave debris such as cement lumps, rocks, and congealed mud in the casing or liner. Other debris can be suspended in the mud and it can include oxidation lumps scale, slivers, shavings and burrs. A variety of well cleaning tools have been developed particularly to dislodge such debris from the casing or liner walls. Jet tools are used to blow such debris loose. A variety of casing scrapers and brushes have been developed to accomplish the same purpose. These tools have more recently been combined with additional tools to filter the downhole fluid and capture the debris therein for removal to the surface.

One such debris filtering tool is described in UK Application 2 335 687 and is called the Well Patroller, a trademark of the owner Specialised Petroleum Services of Aberdeen, Scotland. This device generally features a wiper cup that rides the inside of the casing. The cup prevents flow around a mandrel. As the tool is lowered, flow is directed through a plurality of ball check valves into an annular space behind a screen and out though the center of the cup and around the mandrel. In this embodiment, no filtration occurs as the tool is inserted and the cup wipes the casing wall. When the tool is brought out of the wellbore, the ball check valves close and fluid above the cup is directed to the annular space inside the filter and out through the filter. The annular space acts as a reservoir for debris retained by the filter. If the filter clogs pressure can be built up to blow a bypass rupture disc, or, in some embodiments to simply shear screws and blow the cup off the mandrel. There are shortcomings in this design. The most significant is that the opening size in the check valves is small and is prone to plugging with debris. When running in the Well Patroller, downhole progress is stopped every 90 feet or so as another stand of tubulars is added at the surface. During these times the fluid flow through the tool stops and debris suspended in the fluid will settle to the bottom of the tool. The debris will eventually accumulate to the point which the ball check valves can not open. Once fluid can not pass though the check valves, the annular restriction at the top of the tool will force the annular fluid to pass through the screen. Any debris in the fluid will not be able to pass through the screen. When the tool is pulled out of the well, the debris will be left in the well. The Well Patroller tool is used in conjunction with a separate tool to scrape debris off the inside casing wall. The wiper cup's purpose, in this tool, is to divert flow as opposed to scraping or swabbing the inner casing wall.

Other debris removal tools are shown in UK Application 2 335 218; U.S. Pat. Nos. 4,515,212 and 5,330,003. The tool in UK Application 2 335 218 requires forced circulation through a plurality of eductors coupled with a deflector for the induced flow to encourage solids to drop into an annular space. Boot baskets, such as those made by Tri-State Oil Tools Industries Inc., now a part of Baker Hughes Incorporated featured an annular space defined between a solid basket and a mandrel. Solids were capable of being captured on the trip downhole solely due to the velocity decrease as the flow emerged above the boot so that solids could drop into the annular space between the mandrel and the boot.

Since the boot was solid, no meaningful capture of solids occurred on the trip out of the hole.

One of the objects of the present invention is to eliminate or, at least minimize, the shortcomings of the Well Patroller device and the other tools previously used to filter downhole debris. The objective is addressed by providing an improved open area in the valving to reduce the potential problems from plugging. Another feature is the retractable flow diverter which allows rapid insertion into the wellbore, and provides easy passage of suspended debris past the tool. Yet another feature improves the valve structure in this application to get away from spring loaded balls which can create maintenance concerns. These and other advantages of the present invention will be more readily apparent to those skilled in the art from a review of the preferred embodiment which appears below.

SUMMARY OF THE INVENTION

A downhole debris filtering apparatus is disclosed. In a preferred embodiment, the flow diverter is retracted as the tool is run in to provide easy passage for debris. Settling velocity is the rate at which debris will fall through the fluid. Settling velocity is dependent on the density of the fluid and the debris density. If the fluid velocity exceeds the settling velocity, the debris will rise. The restricted annular area outside the screens raises the fluid velocity. Above the cup sleeve, the annular area increases significantly and the fluid velocity is reduce to below the settling velocity to allow debris to settle to the bottom of the tool. On run in, the fluid merely bypasses on the outside of the filter. Large debris will settle into the tool as described. When pulled out of the hole the swab cup/flow diverter is actuated into casing or liner wall contact and a large passage is opened to allow flow though the filter. Small debris that has risen above the tool will be captured as the fluid is filtered through the screen. Another embodiment with a non-retractable cup uses a sliding sleeve valve with a large open area which promotes free flow and minimizes fouling from deposited debris.

DETAILED DESCRIPTION OF THE PREFERRED EMBODIMENT

Referring to FIGS. 1*a*–1*e*, the apparatus A, has a mandrel 10 with a top thread 12 and a lower thread 14. Top thread 12 can be used to attach a string (not shown) to run the apparatus A into wellbore 16. Those skilled in the art will appreciate that the wellbore 16 represents casing, liners, or any other tubular string downhole and will henceforth be referred to collectively as "casing 16". Bottom thread 14 as well as top thread 12 can also accommodate other known cleaning tools such as scrapers and jets to name a few.

Figure 1A:
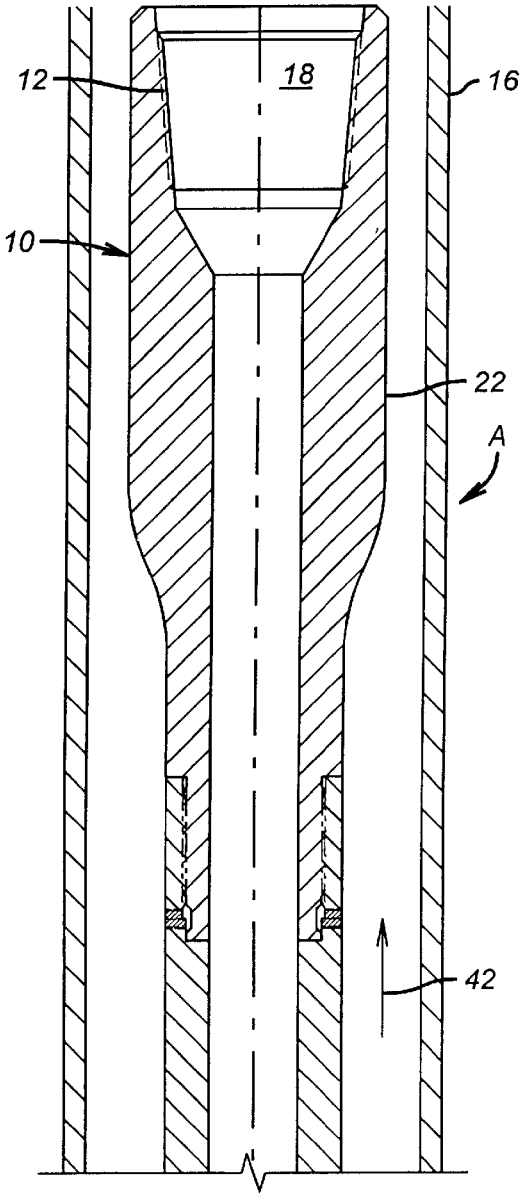
FIGS. 1*a*–1*e* illustrate in section a first embodiment of the tool in the run in position.
Figure 2A:
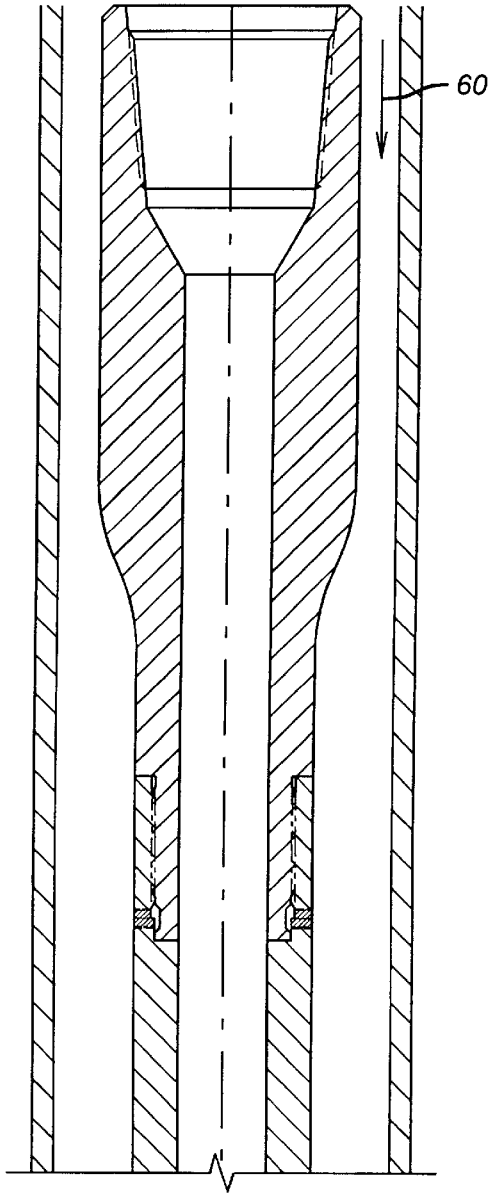
FIGS. 2*a*–2*e* illustrate the same tool being pulled out of the well.
Figure 1B:
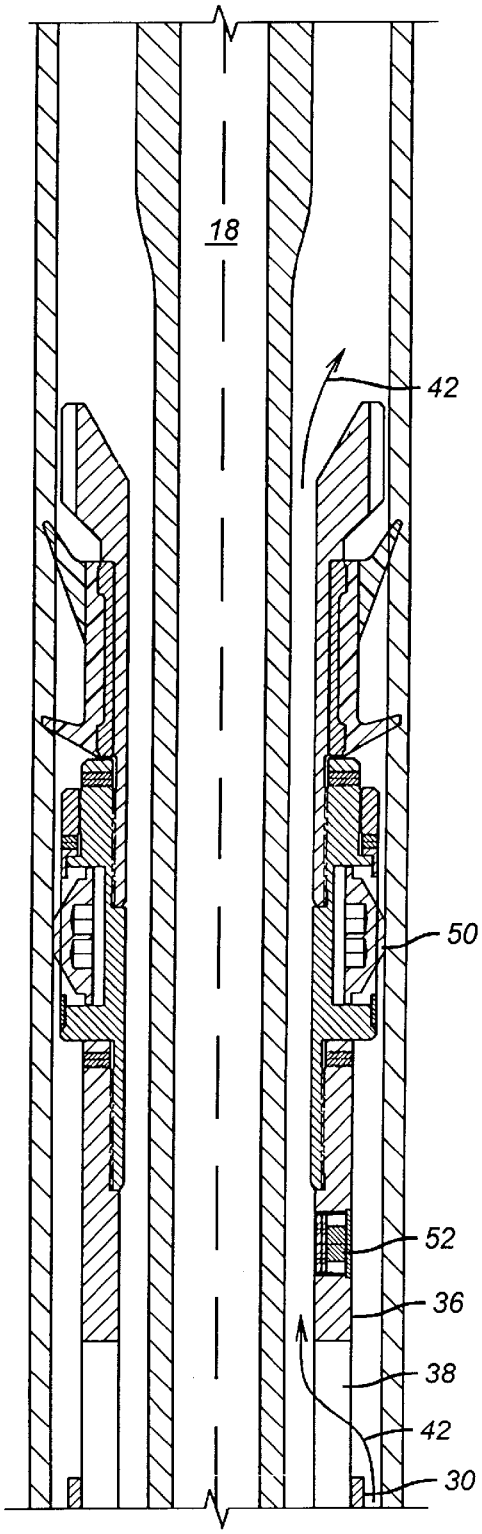
Figure 2B:
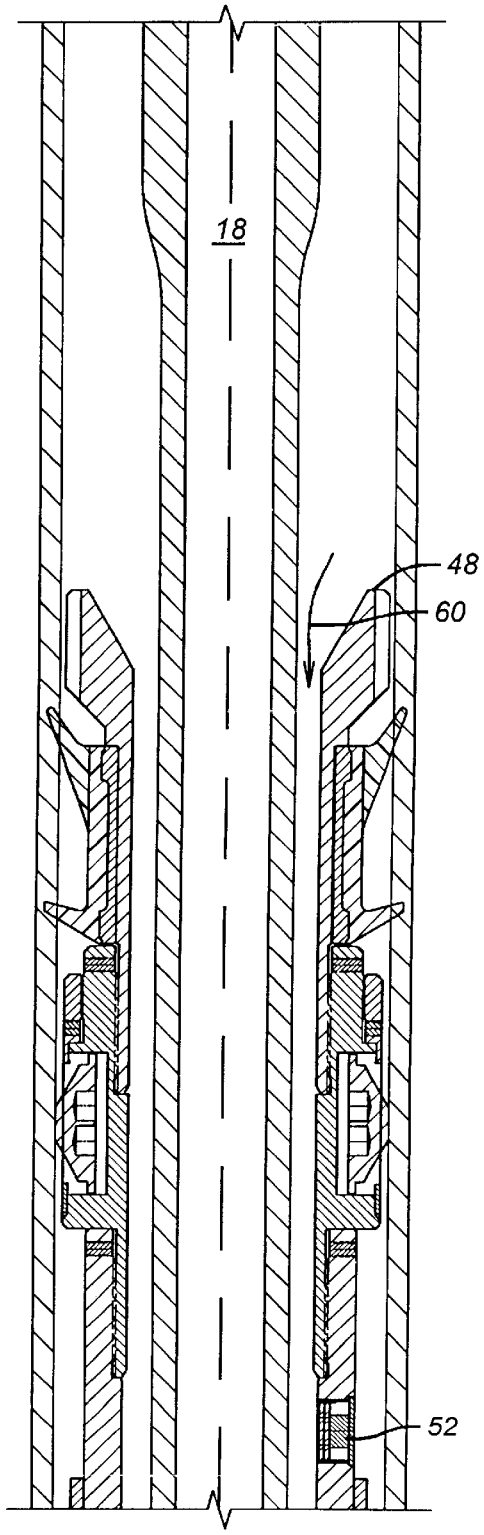
Figure 1C:
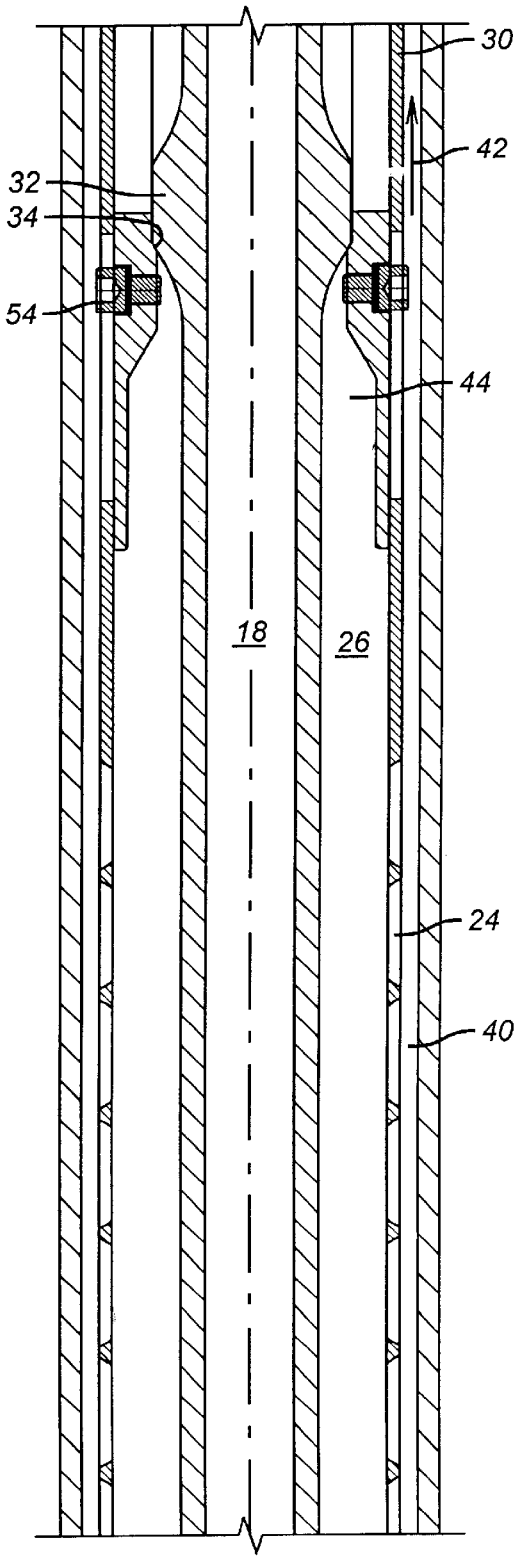
Figure 2C:
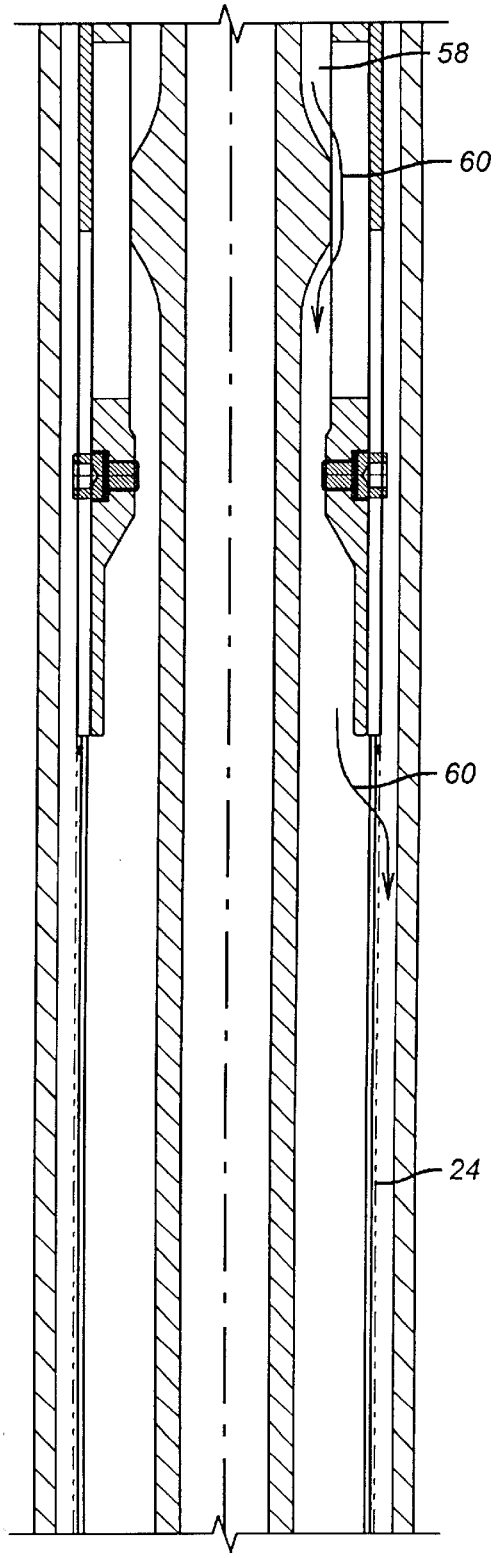
Figure 1D:
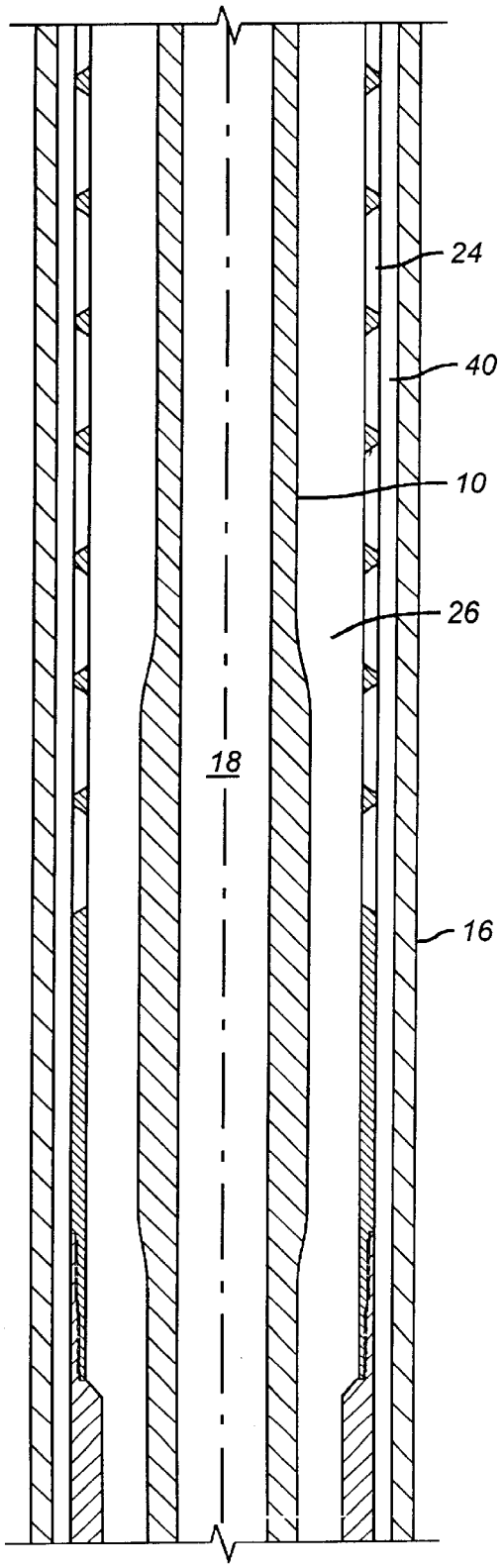
Figure 2D:
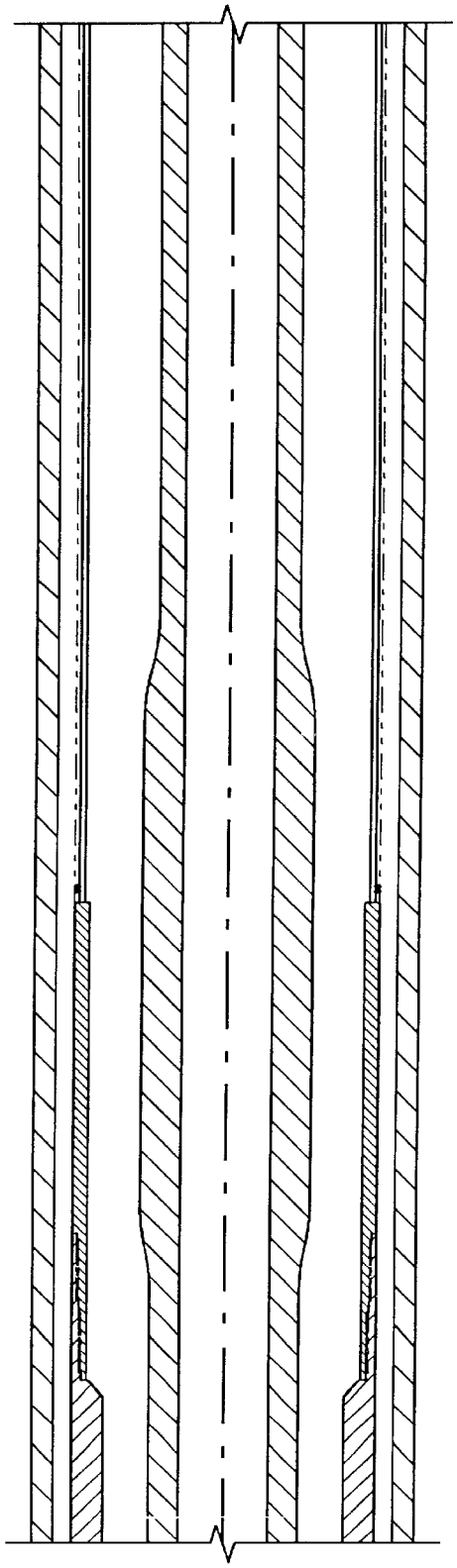
Figure 1E:
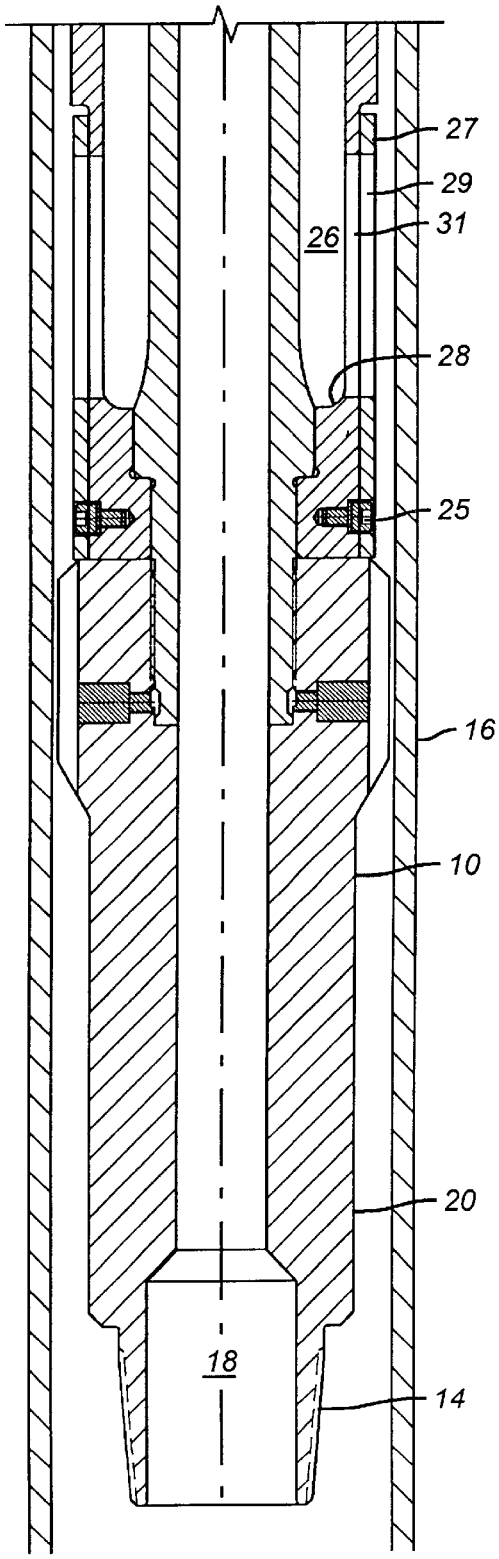
Figure 2E:
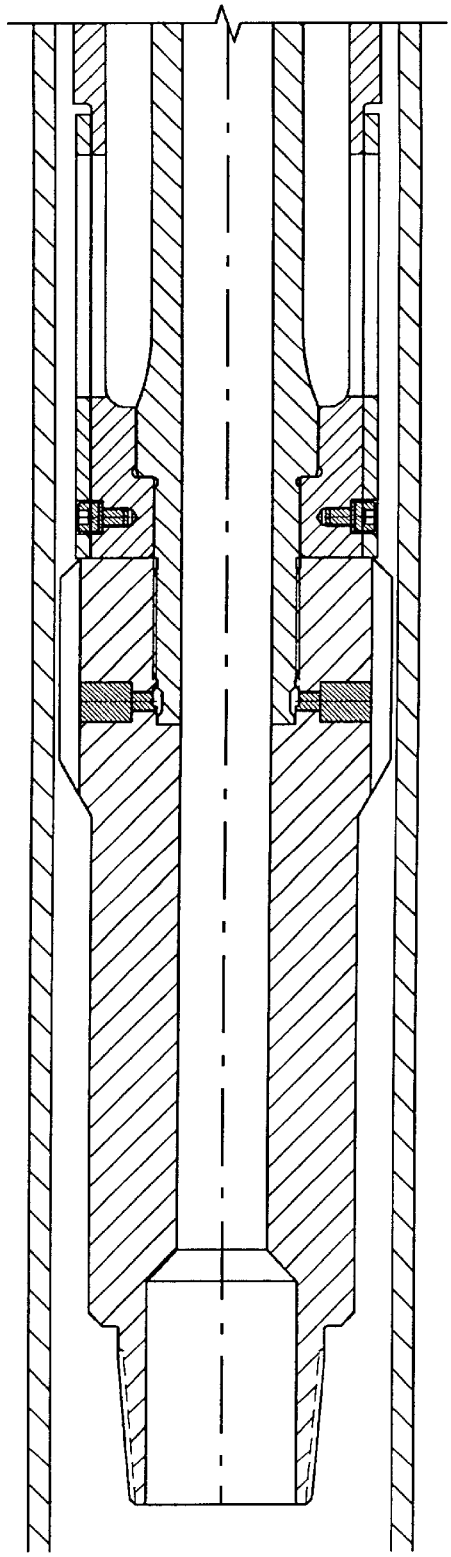

Mandrel 10 has a passage 18 that extends from bottom sub 20 to top sub 22. Outside of mandrel 10 is a screen 24 which defines an annular space 26 around the mandrel 10 for the purpose of accumulating filtered debris, as will be explained below. Annular space 26 has a lower end 28 shown in FIG. 1*e* adjacent bottom sub 20. As shown in FIG. 1*c*, screen 24 terminates in a sleeve 30 at its upper end. At its lower end, screen 24 is supported by the mandrel 10 via bottom sub 20. Mandrel 10 has a valve member 32 which engages a seat 34 on cup sleeve 36 during run in as shown in FIG. 1*c*. Cup sleeve 36 has a plurality of slotted openings 38 which are open at least in part to allow flow in the annular passage 40 between the casing 16 and the screen 24 to enter the cup sleeve 36 as shown by arrow 42. The screen 24 is bypassed during run in because the annular space 26 is closed off at its upper end 44 by contact of valve member 32 on seat 34.

A cup 46 acts as a seal and is retained by retainer 48 which is in turn mounted to cup or seal sleeve 36. A series of drag blocks 50 support the cup sleeve 36 against the casing 16 in a sliding manner well known in the art. Cup sleeve 36 has a rupture disc 52 which can be broken with applied pressure if the screen 24 gets clogged as to avoid pulling a wet string from the wellbore. Those skilled in the art will appreciate that other devices that will allow bypass of a clogged screen 24 can be employed instead of rupture disc 52 without departing from the invention. Finally, bolts 54 prevent relative rotation between the sleeve 30 and the cup sleeve 36 while allowing relative longitudinal movement.

The major components now having been described, the run in operation can now be explained. The mandrel 10 is advanced into casing 16. The cup 46 rides on the inside wall of casing 16 and the spring loaded drag blocks 50 do the same. This resistance allows the mandrel 10 to advance with respect to the cup sleeve 36 until the valve member 32 engages the seat 34. At that time further advancement of the mandrel 10 downhole is made possible by fluid moving in the annular space 40 around the outside of the screen 24 and through the openings 38. Fluid simply bypasses cup 46 which closes off annular passage 40 by passing through the cup sleeve 36, as shown by arrows 42.

FIGS. 2*a*–2*e* illustrate what happens on the trip out of the casing 16. An upward force on mandrel 10 brings it up and with it, screen 24 and sleeve 30. Because the cup 46 and the drag blocks 50 hold the cup sleeve 36 momentarily, relative movement occurs. As a result of this relative movement, the sleeve 30 covers the openings 38 and the valve member 32 moves away from the seat 34. The latter movement opens the upper end 44 of the annular space 26 to passage 58. As the mandrel moves uphole fluid flows through passage 58 through screen 24, as shown by arrows 60. If screen 24 plugs, pressure is applied to passage 58 to blow rupture disc 52 so that fluid can exit to the annular space 40 and bypass the screen 24. This prevents pulling a wet string if the annular space fills with debris or if for any other reason, the screen 24 plugs. When the tool is removed from the wellbore, the accumulated debris can be easily removed by removing bolts 25 near lower end 28 of annular space 26. At that point the sleeve 27 which has windows 29 can be rotated until windows 29 align with openings 31 adjacent the lower end 28 of annular space 26 (see FIG. 1*e*).

Figure 3A:
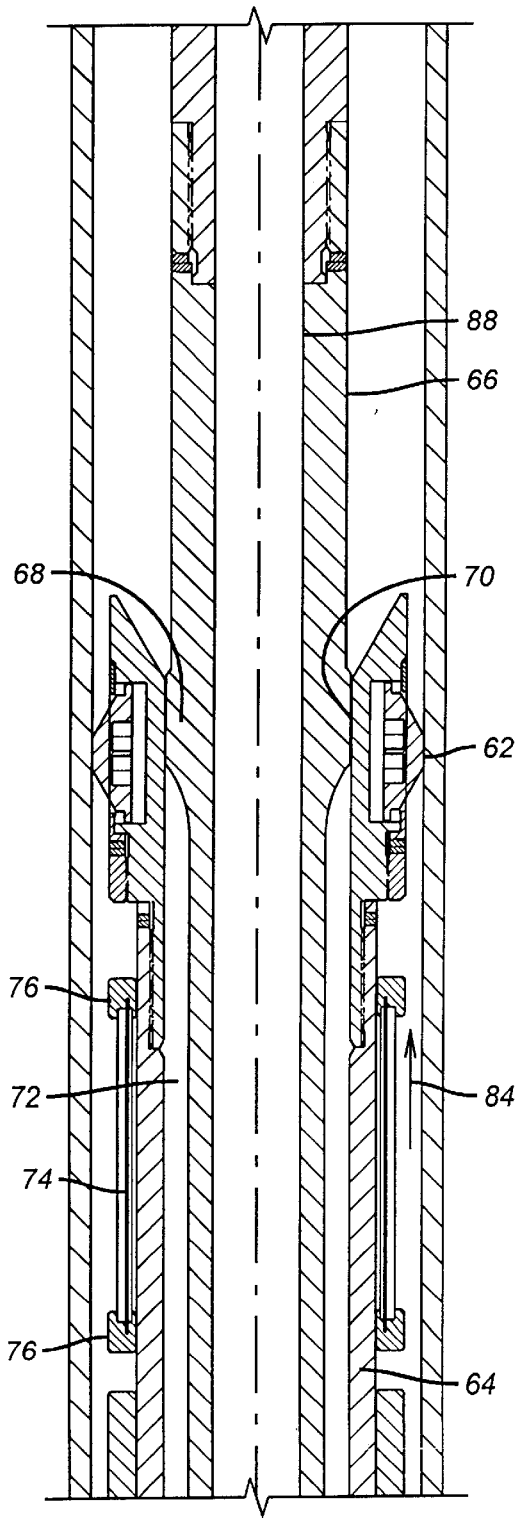
FIGS. 3*a*–3*b* illustrate the distinct features of the preferred tool which differ from FIGS. 1*a*–1*e*, showing the retractable feature, in the run in position.
Figure 4A:
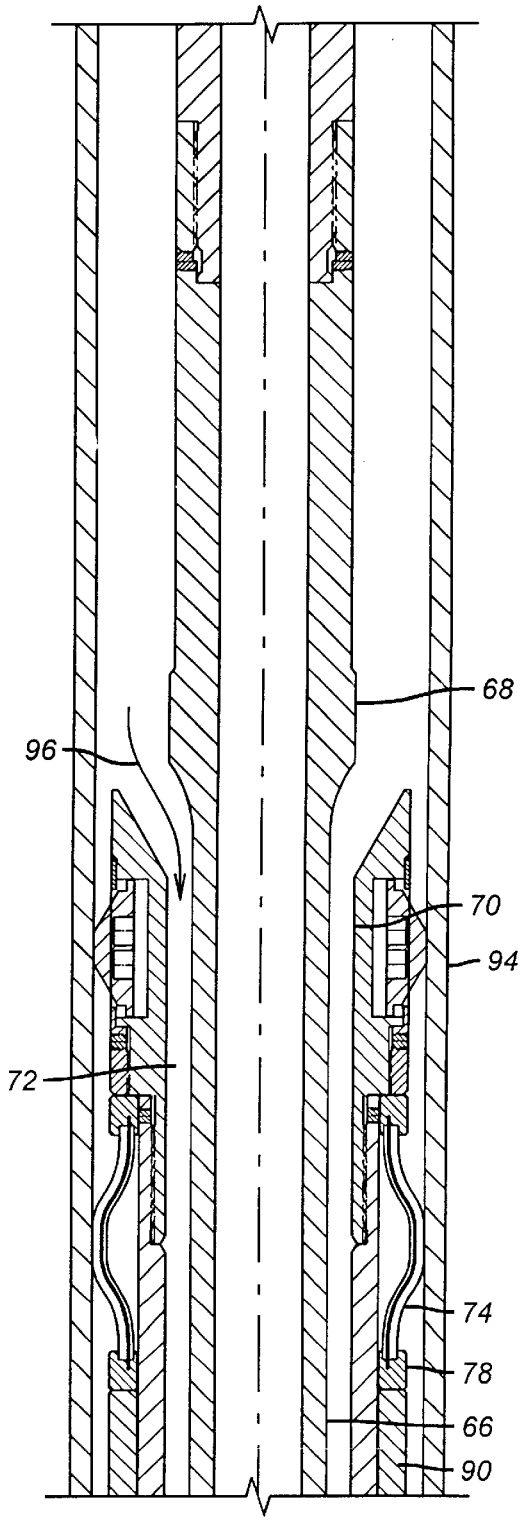
FIGS. 4*a*–4*b* are the tool portions of FIGS. 3*a*–3*b* in the pulling out of the well position.
Figure 3B:
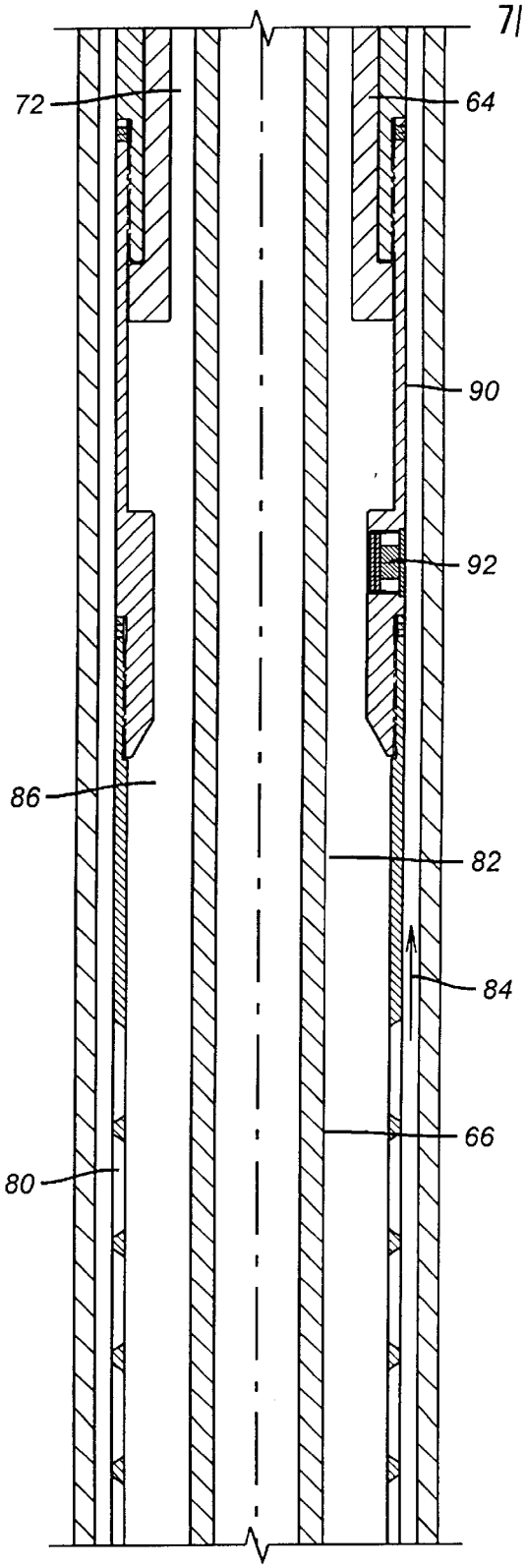
Figure 4B:
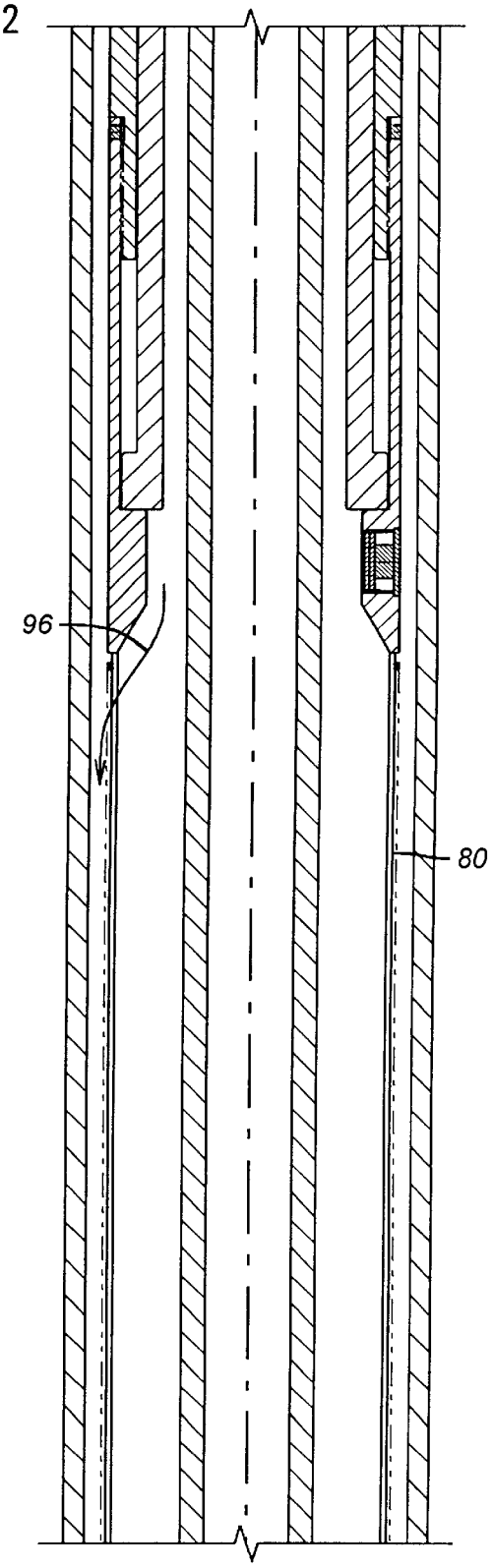
Figure 6A:
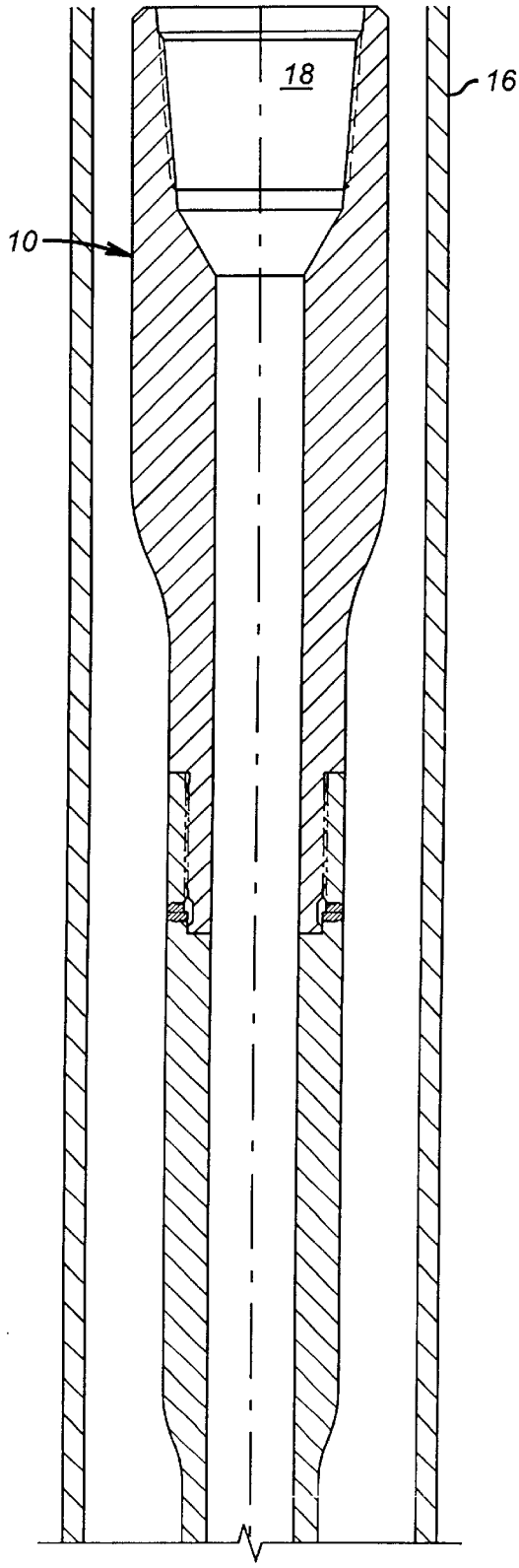
FIGS. 6*a*–6*e* is the tool of FIGS. 5*a*–5*e* being pulled from the well.

The preferred version of the apparatus has some changes illustrated in FIGS. 3*a*–3*b*, in the run in position. In other respects than those mentioned below, the embodiments are virtually identical. In the preferred version, drag blocks 62 support wiper sleeve 64 during run in, allowing the mandrel 66 to be advanced relative to it. This relative motion, on run in, places the valve member 68 in bore 70 of wiper sleeve 64, closing off passage 72. Wiper 74 is sufficiently rigid to maintain its cylindrical shape flanked above and below by support rings 76 and 78. The assembly of the wiper 74 with rings 76 and 78 can move longitudinally on wiper sleeve 64 during run in. Thus, running in will not cause the wiper 74 to collapse and extend outwardly to the position shown on FIG. 4*a* until an upward force is put on the mandrel 66. Those skilled in the art will appreciate that moving the mandrel 66 downhole will direct fluid outside of screen 80 in annular passage 82 as shown by arrow 84. As the apparatus A advances downhole, fluid will pass around the outside of the wiper 74. No flow will go through screen 80 to speak of because the annular space 86 is blocked by valve member 68 in bore 70. Some flow could pass through bore 88 in mandrel 66 but the path of least resistance will be through annular passage 82. Screen 80 has a sleeve 90 which contains a rupture disc 92 or an equivalent device that can provide an emergency bypass of screen 80 if it becomes necessary when coming out of the well.

When it is time to trip out of the well, an upward force is placed on the mandrel 66 and it moves with respect to wiper sleeve 64. This movement shifts valve member 68 away from bore 70 to open up passage 72. Additionally, sleeve 90 engages ring 78 which buckles wiper 74 into contact with the casing or downhole tubular 94. Sleeve 90 moved up because it is attached to screen 80 which is in turn attached to mandrel 66. Since drag blocks 62 hold back wiper sleeve 64 the wiper 74 can collapse into the contact position for effective sealing of the inner wall of the casing or tubular 94. The filtering occurs as the apparatus A is pulled uphole. Fluid is forced to pass downwardly through passage 72 through screen 80 as shown by arrow 96.

Figure 5A:
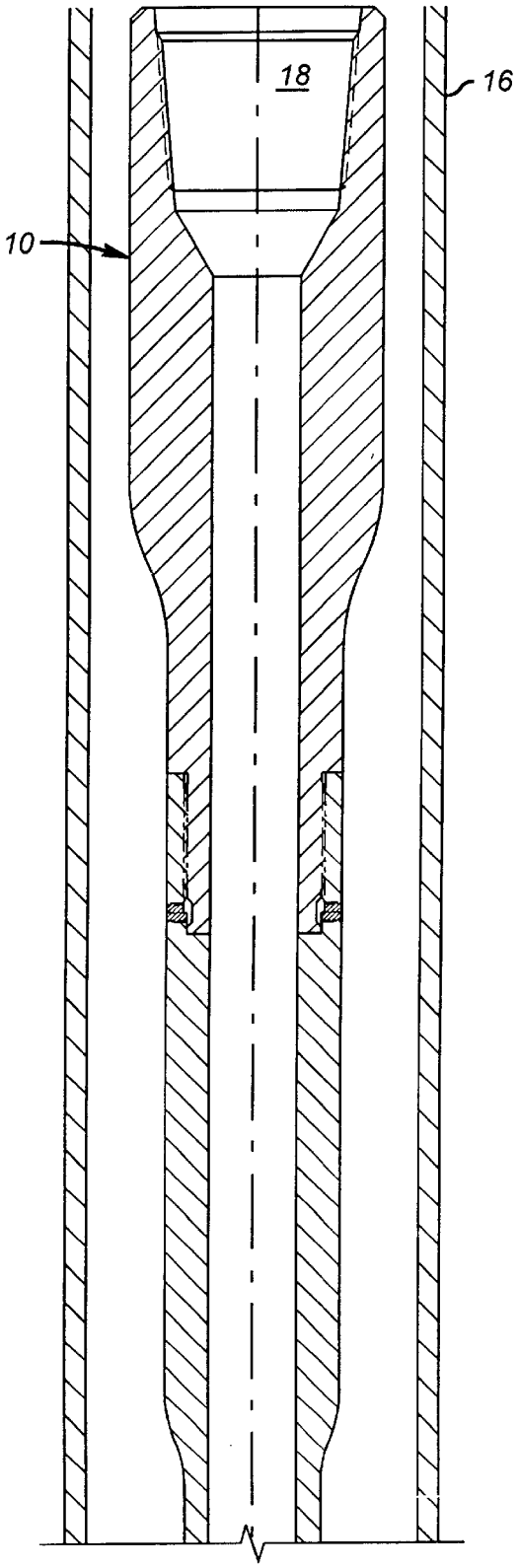
FIGS. 5*a*–5*e* illustrate the preferred tool in the run in position with the sliding sleeve covering the screen.
Figure 5B:
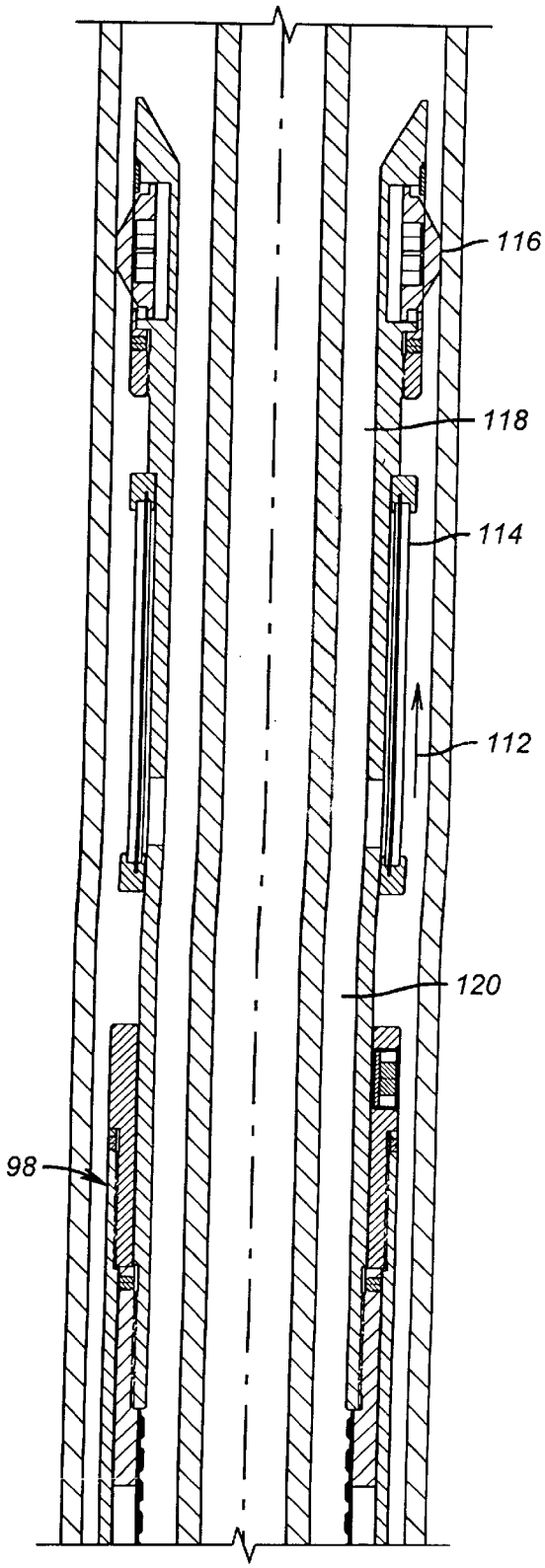
Figure 6B:
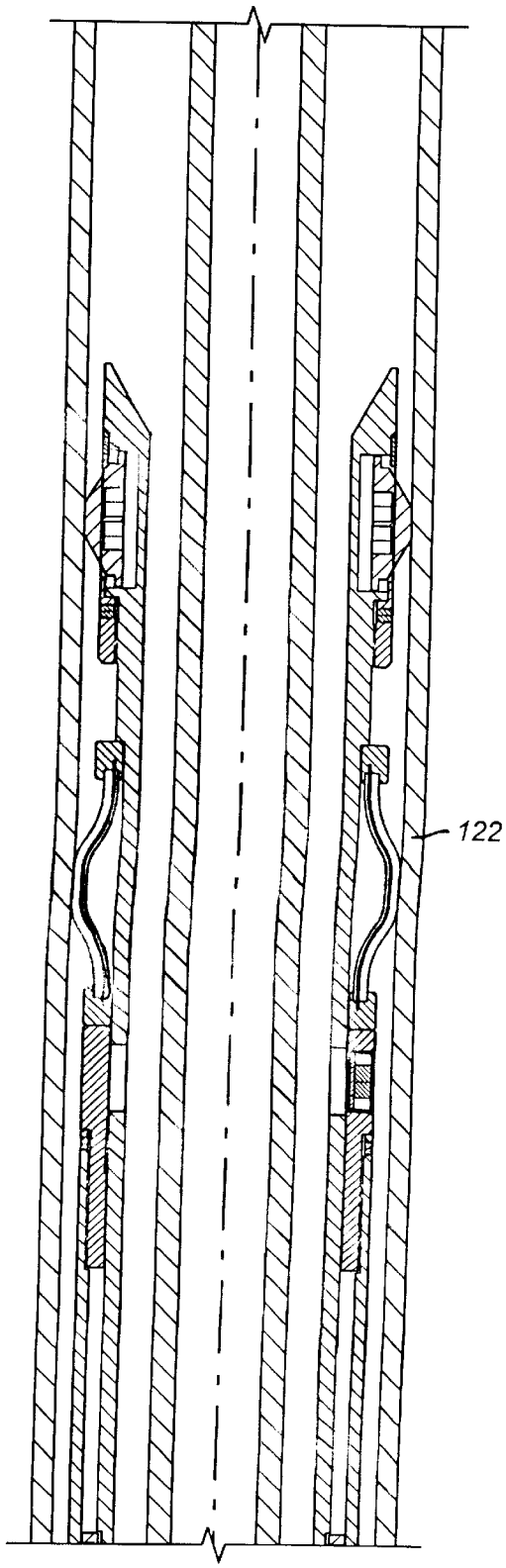
Figure 5C:
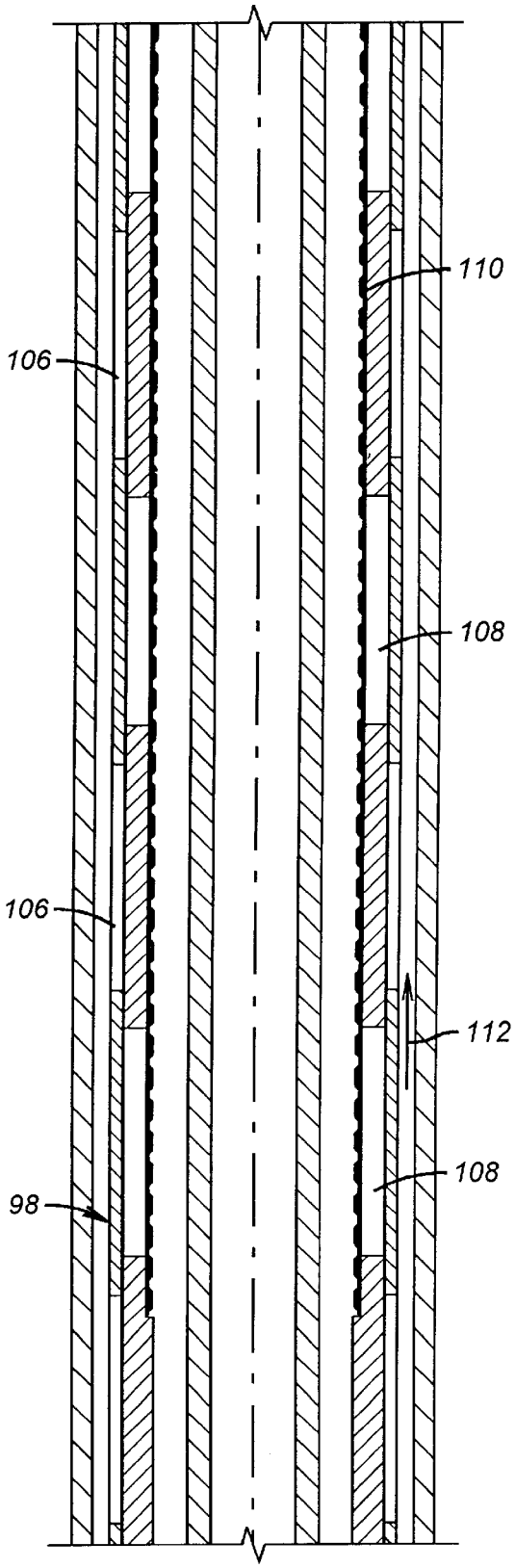
Figure 6C:
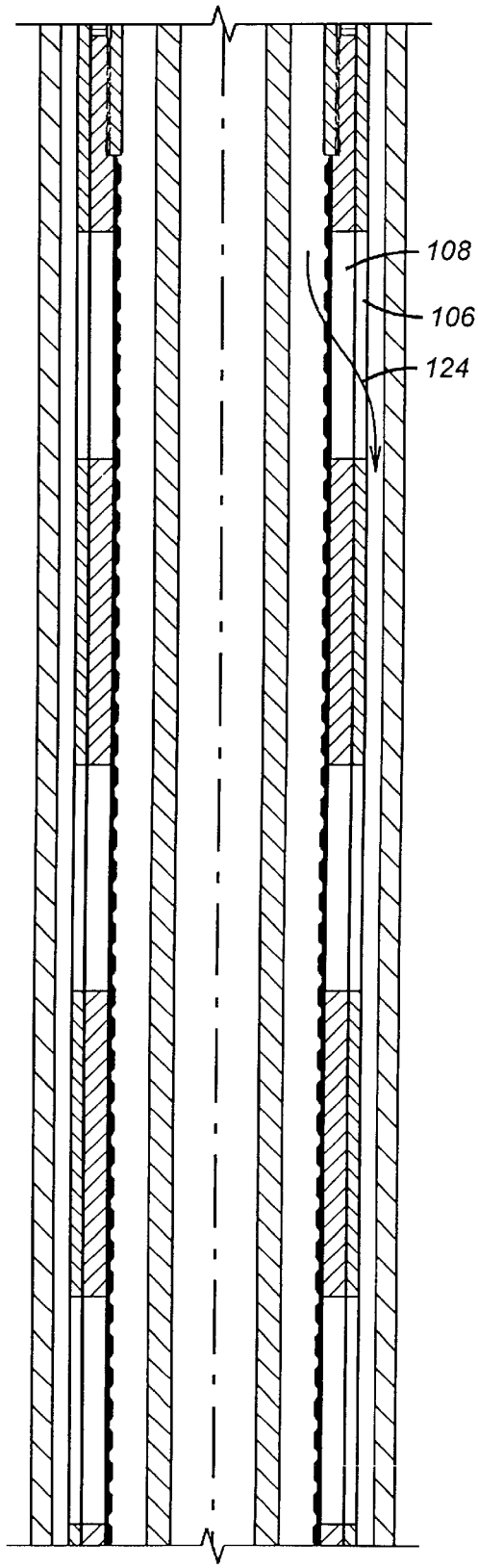
Figure 5D:
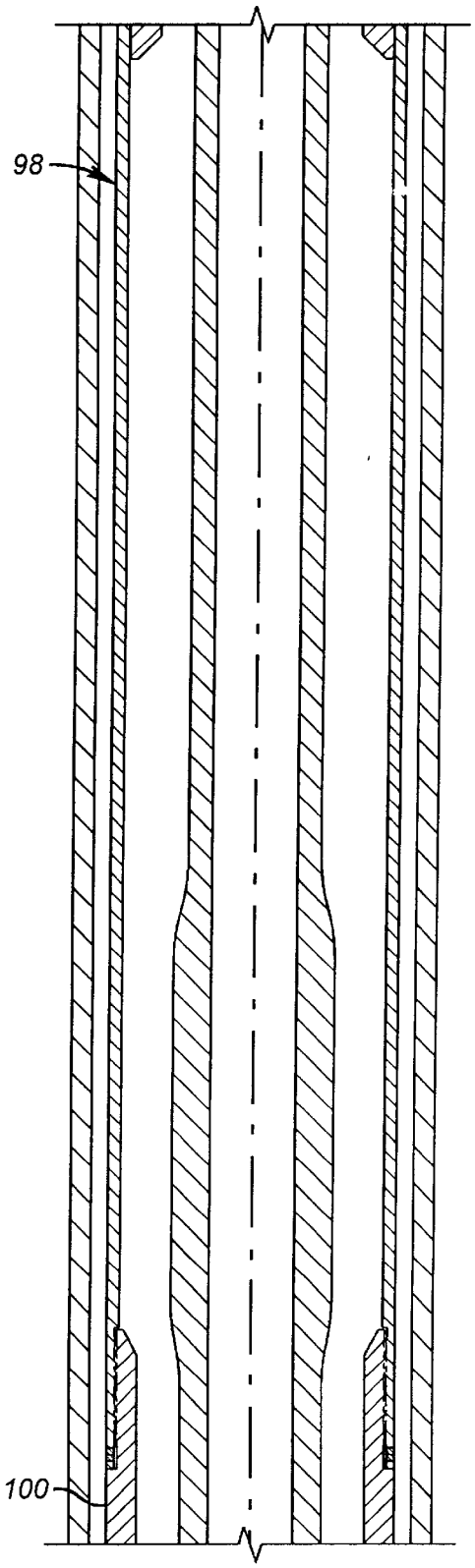
Figure 6D:
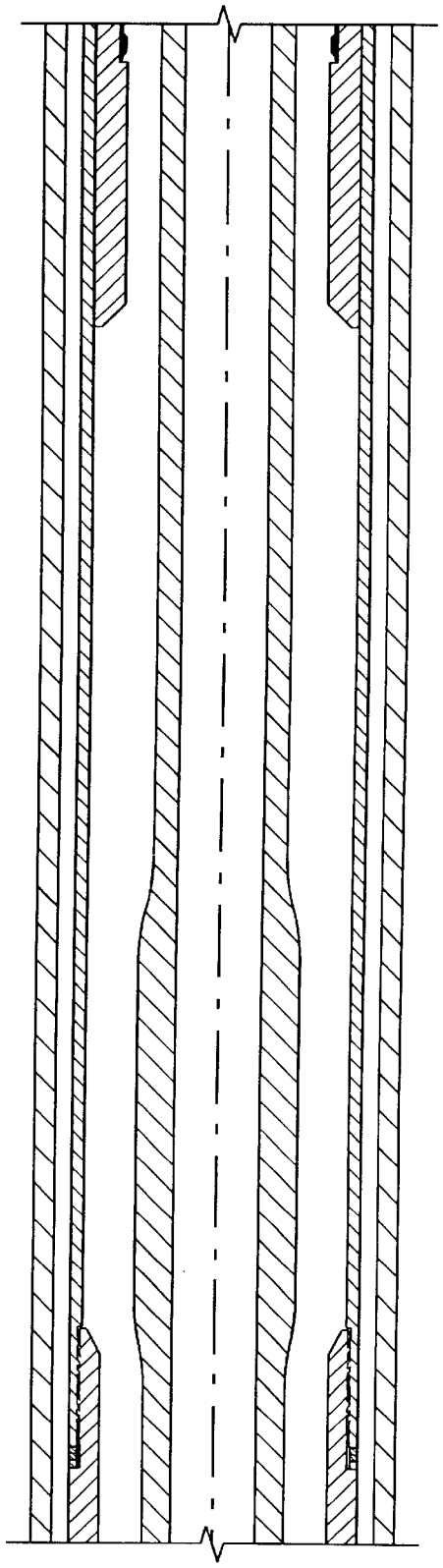
Figure 5E:
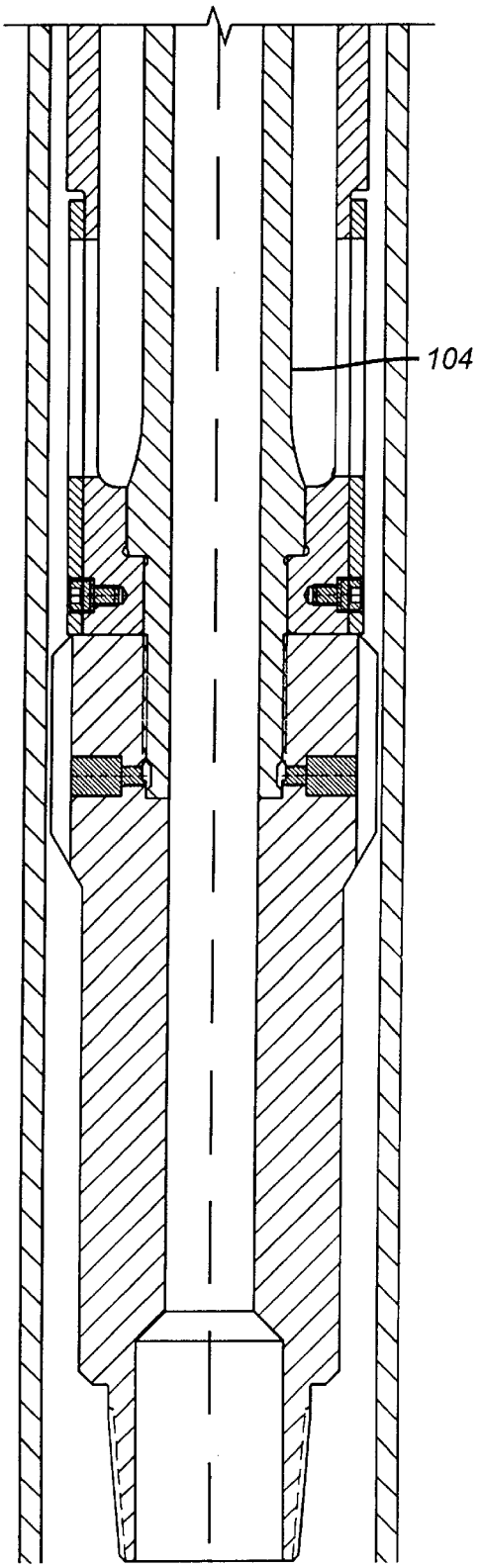
Figure 6E:
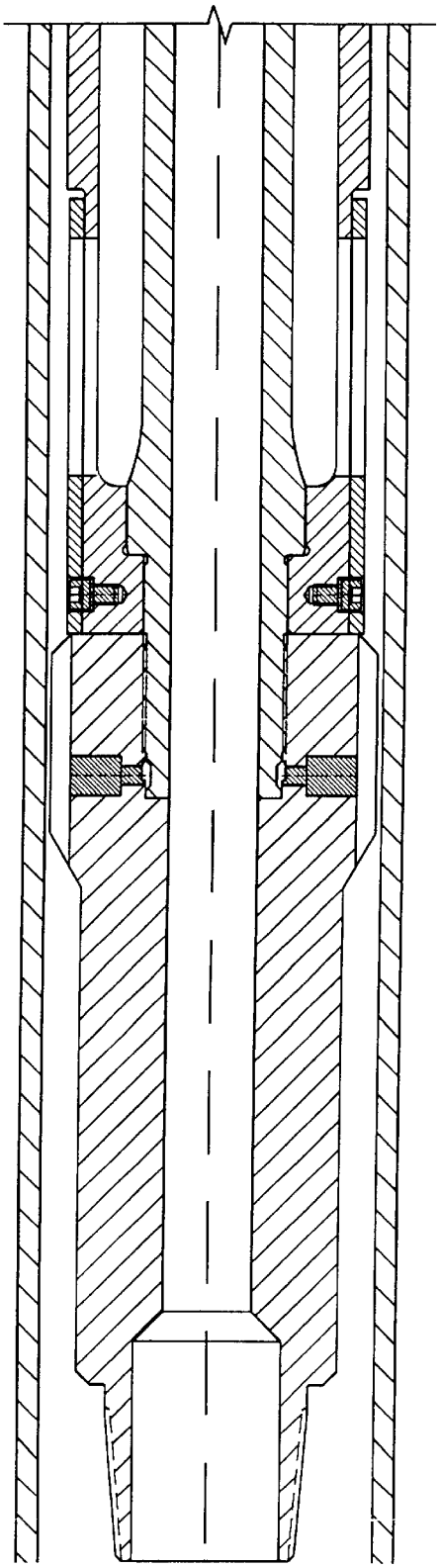

The embodiment shown in FIGS. 5*a*–5*e* and 6*a*–6*e* has a valving variation as compared to the embodiment of FIGS. 3*a*–3*b* and 4*a*–4*b*. In FIGS. 5*a*–e the valve member 68 is eliminated in favor of sleeve 98, the top of which appears in FIG. 5*b*. Sleeve 98 is connected to sleeve 100, which is, in turn connected to mandrel 104. Sleeve 98 has a plurality of openings 106. Openings 106 are misaligned with openings 108 in the run in position so that screen 110 is completely covered on its exterior. Flow, represented by arrow 112 goes around the tool as the tool is advanced downhole (see FIG. 5*c*). Referring to FIG. 5*b*, the flow 112 goes past the flow diverter 114 which is in the relaxed position for run in. Due to the high velocity, the solids are retained by the flow 112 past the drag blocks 116, which have gaps between them to allow the flow 112 to progress. The larger solids 118 can drop into annular space 120 due to the velocity reduction as the flow area suddenly increases. It should be noted that the outer surface of the screen 110 is fully protected against deposition of solids during the trip downhole. On the trip uphole, the drag blocks facilitate the expansion of the fluid diverter 114 against the wellbore to create a seal around the exterior of the tool. Openings 106 are pulled up into alignment with openings 108 due to the upward force on mandrel 104. Sufficient relative movement occurs to compress fluid diverter 114 as it is retained sufficiently by the drag blocks 116. With the fluid diverter 114 in the position shown in FIG. 6*b*, tandem movement resumes and flow through screen 110 proceeds as illustrated by arrow 124. The flow 124 must pass through annular space 120 where additional solids, including the smaller particles, which did not previously drop out on the trip downhole, can be retained. Those skilled in the art will appreciate that although a windowed sleeve has been shown as the screen isolation member, other techniques are also within the scope of the invention. These could involve dissolvable coatings and cover sleeves which increase diameter under a twist akin to the action of a child's toy known as a finger trap. One way to accomplish this is to use interlocking elements such as a weave. When the elements a re twisted in a first direction they close up the openings between them. When the twist force is reversed the weave defines openings to allow flow through the screen. The advantage of having the screen 110 covered as solids-laden fluid flows past it is that there is a reduced chance of plugging and a lager flow at reduced pressure drop through the screen 110 on the trip up the wellbore.

Those skilled in the art will appreciate that wiper 74 can have a cup profile, or it can be a solid elastomer block or a bladder, as illustrated. The valving used in both embodiments and its location above the screen permits large flow areas which can let debris pass with minimal risk to clogging the valve structure. In both embodiments, if the increase in annular area is great enough to reduce the fluid velocity below the settling velocity of the debris, the debris will settle into the tool when running into the well. When stopping to add drill pipe, the tool will be pulled up enough to allow any debris that has accumulated above the wiper sleeve 64 to passthrough passage 96 and settle to the bottom of the tool. As distinguished from the Well Patroller, the flow through the screen is effectively stopped when running in the hole. In the Well Patroller, the fluid can pass through the screen at the same time that it passes through the ball valves. Debris is likely to be trapped to the outside of the screen and remain in the wellbore when the Well Patroller is pulled out.

Those skilled in the art will appreciate that the parts orientation of either embodiment could be reversed so that the cup 46 is open toward downhole with filtering occurring on the same trip down or on the trip up. Similarly the wiper 74 can be expanded on the trip down and retracted for the trip up. Filtration can occur on the trip up for example. It is also within the scope of the invention to coat the screen such as 24 with a removable material which can be dissolved or otherwise removed on the trip downhole or when the proper depth is reached. Coating the screen for the trip into the wellbore will reduce any tendency of buildup of debris on the outside of the screen on the way down. In the figures, the screens 24 or 80 are shown schematically and should be understood to contemplate the inclusion of such removable layers or coatings. Additionally, sealing can be accomplished with shapes different than cup 46. Other valving arrangements to close upper end 44 are also contemplated. Openings 38 may have different shapes and are preferred to be sufficiently large to allow loose debris to pass there through. When used herein, "screen" refers to any device which can let some material pass while retaining another and can include such structures as mesh, weave and porous materials, to name a few.

It is to be understood that this disclosure is merely illustrative of the presently preferred embodiments of the invention and that no limitations are intended other than as described in the appended claims.

We claim:

1. A downhole tool for removal of debris from downhole tubulars having an internal wall, comprising:

a mandrel;

a screen mounted around said mandrel, defining an annular space there between, said space having an uphole and a downhole end with at least one of said ends being open;

a seal mounted to a sleeve surrounding said mandrel, said seal, when engaging the internal wall of the tubulars, blocking an annular passage defined between said sleeve and the tubulars and directing debris into said open end of said annular space when said mandrel is advanced relative to the downhole tubulars;

a valve assembly actuated by relative slidable movement between said mandrel and said sleeve to selectively close off at least a portion of said annular space to fluid flow.

2. The tool of claim 1, wherein:

said seal is mounted adjacent said uphole end of said annular space; and said valve assembly is mounted adjacent said uphole end of said annular space.

3. The tool of claim 1, wherein:

said seal is mounted on a seal sleeve, said seal sleeve slidably mounted to said mandrel and further comprises a seat; and said valve assembly further comprises a valve member on said mandrel selectively movable toward or away from said seat.

4. The tool of claim 3, wherein:

said seal sleeve further comprises at least one opening which is selectively closable to the annular passage.

5. The tool of claim 4, wherein:

said closure of said opening to the annular passage coincides with movement of said valve member away from said seat.

6. The tool of claim 5, wherein:

said valve member moves away from said seat upon an uphole force applied to said mandrel.

7. The tool of claim 5, wherein:

said valve member moves toward said seat upon a downhole force applied to said mandrel.

8. The tool of claim 5, wherein:

said screen is attached to said mandrel in a manner to close off said downhole end of said annular space.

9. The tool of claim 1, wherein:

said seal engages the tubulars as a result of insertion into the tubulars.

10. The tool of claim 1, wherein:

said seal is initially retracted away from the tubulars upon insertion downhole.

11. The tool of claim 10, wherein:

at least a portion of said annular space is closed by said valve assembly when said seal is retracted away from the tubulars upon insertion downhole.

12. The tool of claim 10, wherein:

said seal is urged into contact with the tubulars by longitudinal compression.

13. The tool of claim 10, wherein:

said seal is urged into contact with the tubulars by fluid pressure.

14. the tool of claim 1, wherein:

said screen is selectively covered by said valve assembly.

15. A downhole tool for removal of debris from downhole tubulars having an internal wall, comprising:

a mandrel;

a screen mounted around said mandrel, defining an annular space there between, said space having an uphole and a downhole end;

a seal slidably mounted to said mandrel, said seal, when engaging the internal wall of the tubulars, blocking an annular passage defined between said mandrel and the tubulars;

a valve assembly actuated by relative slidable movement between said mandrel and said seal to selectively close off at least a portion of said annular space;

said seal is mounted on a seal sleeve, said seal sleeve slidably mounted to said mandrel and further comprises a seat;

said valve assembly further comprises a valve member on said mandrel selectively movable toward or away from said seat;

said seal sleeve further comprises at least one opening which is selectively closable to the annular passage;

said closure of said opening to the annular passage coincides with movement of said valve member away from said seat;

a closure sleeve connected to said screen for tandem movement therewith, said closure sleeve selectively obstructing said opening as a result of relative movement between said mandrel and said seal sleeve.

16. A downhole tool for removal of debris from downhole tubulars having an internal wall, comprising:

a mandrel;

a screen mounted around said mandrel, defining an annular space there between, said space having an uphole and a downhole end;

a seal slidably mounted to said mandrel, said seal, when engaging the internal wall of the tubulars, blocking an annular passage defined between said mandrel and the tubulars;

a valve assembly actuated by relative slidable movement between said mandrel and said seal to selectively close off at least a portion of said annular space;

said seal is initially retracted away from the tubulars upon insertion downhole; said seal is mounted on a seal sleeve having a passage there through to selectively allow fluid to pass through said seal sleeve and into said annular space inside said screen, said seal sleeve passage comprising a valve seat;

said valve assembly comprising a valve member on said mandrel which cooperates with said seat to selectively close off said seal sleeve passage with said seal retracted away from said tubulars during run in, such that well fluids pass in said annular passage outside said screen.

17. The tool of claim 15, wherein:

said passage in said seal sleeve opens on application of an uphole force to said mandrel and said uphole force initiates outward movement of the seal into contact with the tubulars.

18. A downhole tool for removal of debris from downhole tubulars having an internal wall, comprising:

a mandrel;

a screen mounted around said mandrel, defining an annular space there between, said space having an uphole and a downhole end and is selectively accessible to collect debris;

a seal mounted to said mandrel and selectively movable between a retracted position where it does not contact the tubulars when said mandrel is advanced in a first direction and an extended position in contact with the tubulars when said mandrel is advanced in a second direction to block an annular passage defined between the mandrel and the tubulars;

a valve assembly between said mandrel and said seal to selectively close off at least a portion of said annular space.

19. The tool of claim 18, wherein:

said seal is mounted on a seal sleeve, said seal sleeve slidably mounted to said mandrel and further comprises a seat; and said valve assembly further comprises a valve member on said mandrel selectively movable toward or away from said seat.

20. A downhole tool for removal of debris from downhole tubulars having an internal wall, comprising:

a mandrel;

a screen mounted around said mandrel, defining an annular space there between, said space having an uphole and a downhole end;

a seal mounted to said mandrel and selectively movable between a retracted position where it does not contact the tubulars and an extended position in contact with the tubulars to block an annular passage defined between the mandrel and the tubulars;

a valve assembly between said mandrel and said seal to selectively close off at least a portion of said annular space;

said seal is mounted on a seal sleeve, said seal sleeve slidably mounted to said mandrel and further comprises a seat;

said valve assembly further comprises a valve member on said mandrel selectively movable toward or away from said seat;

said seal sleeve having a passage there through to selectively allow fluid to pass through said seal sleeve and into said annular space inside said screen, said seal sleeve passage comprising said valve seat;

said valve member cooperates with said seat to selectively close off said seal sleeve passage with said seal retracted away from said tubulars during run in, such that well fluids pass in said annular passage outside said screen.

21. The tool of claim 20, wherein:

said passage in said seal sleeve opens on application of an uphole force to said mandrel and said uphole force initiates outward movement of the seal into contact with the tubulars.

22. The tool of claim 21, wherein:

said seal is urged into contact with the tubulars by longitudinal compression.

23. An apparatus for capturing wellbore debris, comprising:

a mandrel;

a screen surrounding said mandrel defining an annular space therebetween, said annular space having an open top end; and a valve member, said valve member selectively covering said screen to allow debris to pass outside said screen as the mandrel is advanced in a first direction, whereupon when said madrel is moved in a second direction opposite said first direction said screen is exposed by said valve to allow flow with debris into said open top end of said annular space and the debris to be left there as the fluid passes through said screen.

24. The apparatus of claim 23, wherein:

said screen having an inner face disposed in said annular space and an outer face;

said valve member disposed on said outer face.

25. An apparatus for capturing wellbore debris, comprising:

a mandrel;

a screen surrounding said mandrel defining an annular space therebetween, said annular space having an open top end; and a valve member, said valve member selectively covering said screen;

a flow deflector supported by said mandrel and selectively movable from a relaxed position, where it is out of contact with the wellbore and an expanded position where it is in contact with the wellbore, said flow deflector mounted away from said mandrel so as to provide open access to said annular space.

26. An apparatus for capturing wellbore debris, comprising:

a mandrel;

a screen surrounding said mandrel defining an annular space therebetween, said annular space an open top end; and a valve member, said valve member selectively covering said screen;

said valve member comprises a first sleeve having at least one first opening thereon mounted to said screen, and a second sleeve having at least one second opening thereon supported by said mandrel and slidably mounted to said screen.

27. The apparatus of claim 26, wherein:

said first sleeve further comprises a flow deflector selectively movable from a relaxed position, where it is out of contact with the wellbore and an expanded position where it is in contact with the wellbore, said flow deflector mounted away from said mandrel so as to provide open access to said annular space while impeding flow between said second sleeve and the wellbore.

28. The apparatus of claim 27, wherein:

said first sleeve further comprises a drag mechanism to slidably contact the wellbore to allow relative movement between said first and said second sleeves for selective alignment of said first and second openings.

29. The apparatus of claim 28, wherein:

said flow deflector comprises a flexible sleeve and said relative movement between said first and said second sleeves provides an axial force on said flexible sleeve to move said flexible sleeve radially into contact with the wellbore.

30. An apparatus for capturing wellbore debris, comprising:

a mandrel;

a screen surrounding said mandrel defining an annular space therebetween, said annular space having an open top end; and a valve member, said valve member selectively covering said screen;

said valve member comprises a coating on said screen which is removable after said screen is inserted into the wellbore.

31. An apparatus for capturing wellbore debris, comprising:

a mandrel;

a screen surrounding said mandrel defining an annular space therebetween, said annular space having an open top end; and a valve member, said valve member selectively covering said screen;

said valve member is operated by applying a rotational force to said mandrel.

32. The apparatus of claim 31, wherein:

said valve member comprises interlocking elements which when turned in a first direction close openings among them and when turned in an opposite direction define openings among them.

* * * * *